US007404300B2

(12) United States Patent
Baudat et al.

(10) Patent No.: US 7,404,300 B2
(45) Date of Patent: Jul. 29, 2008

(54) ENHANCED METHANE FLASH SYSTEM FOR NATURAL GAS LIQUEFACTION

(75) Inventors: Ned P. Baudat, Sugar Land, TX (US); Anthony P. Eaton, Sugar Land, TX (US); Phillip D. Ritchie, Bastrop, TX (US); Paul R. Hahn, Houston, TX (US); Jame Yao, Sugar Land, TX (US); Rong-Jwyn Lee, Sugar Land, TX (US)

(73) Assignee: ConocoPhillips Company

( * ) Notice: Subject to any disclaimer, the term of this patent is extended or adjusted under 35 U.S.C. 154(b) by 333 days.

(21) Appl. No.: 10/523,955

(22) PCT Filed: Nov. 10, 2003

(86) PCT No.: PCT/US03/35657

§ 371 (c)(1),
(2), (4) Date: Sep. 23, 2005

(87) PCT Pub. No.: WO2004/044508

PCT Pub. Date: May 27, 2004

(65) Prior Publication Data

US 2006/0137391 A1 Jun. 29, 2006

(51) Int. Cl.
*F25J 3/00* (2006.01)

(52) U.S. Cl. ..... 62/612; 62/613

(58) Field of Classification Search ..... 62/612, 62/613

See application file for complete search history.

(56) References Cited

U.S. PATENT DOCUMENTS

| | | | | |
|---|---|---|---|---|
| 3,413,817 | A | 12/1968 | Kniel | |
| 3,433,026 | A | 3/1969 | Swearingen | |
| 3,531,942 | A | 10/1970 | La Fleur | |
| 4,445,916 | A * | 5/1984 | Newton | 62/625 |
| 4,504,296 | A | 3/1985 | Newton et al. | |
| 4,638,638 | A | 1/1987 | Marshall et al. | |
| 4,758,257 | A | 7/1988 | Gates et al. | |
| 5,473,900 | A | 12/1995 | Low | |
| 5,537,827 | A | 7/1996 | Low et al. | |
| 5,611,216 | A * | 3/1997 | Low et al. | 62/612 |
| 6,016,665 | A | 1/2000 | Cole et al. | |
| 6,158,240 | A | 12/2000 | Low et al. | |
| 6,269,656 | B1 * | 8/2001 | Johnston | 62/613 |
| 6,289,692 | B1 * | 9/2001 | Houser et al. | 62/613 |
| 6,658,890 | B1 * | 12/2003 | Hahn et al. | 62/611 |

* cited by examiner

*Primary Examiner*—William C Doerrier

(57) ABSTRACT

Natural gas liquefaction system employing an open methane cycle wherein the liquefied natural gas is flashed immediately upstream of the liquefied natural gas storage tank and boil off vapors from the tank are returned to the open methane cycle.

81 Claims, 4 Drawing Sheets

ENHANCED METHANE FLASH SYSTEM FOR NATURAL GAS LIQUEFACTION

This invention concerns a method and an apparatus for liquefying natural gas. In another aspect, the invention concerns an improved multi-stage expansion cycle for reducing the pressure of a cooled and pressurized liquefied natural gas (LNG) stream to near atmospheric pressure.

The cryogenic liquefaction of natural gas is routinely practiced as a means of converting natural gas into a more convenient form for transportation and storage. Such liquefaction reduces the volume by about 600-fold and results in a product which can be stored and transported at near atmospheric pressure.

With regard to ease of storage, natural gas is frequently transported by pipeline from the source of supply to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when the supply exceeds demand. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, methane, nitrogen or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Typically, LNG plants that employ an open methane cycle for the final refrigeration cycle utilize three expansion (i.e., flash) stages, with each expansion stage including flashing of the LNG-bearing stream in an expander followed by separation of the flash gas stream and LNG-bearing stream in a gas-liquid phase separator. In a conventional open methane cycle, the final flash stage includes reducing the pressure of the LNG-bearing stream to about atmospheric pressure in a final-stage expander and then separating the low pressure flash gas stream from the low pressure LNG-bearing stream in a final-stage gas-liquid separator. From the final-stage separator, a cryogenic pump is used to pump the low pressure LNG-bearing stream to the LNG storage tank(s).

As in all processing plants, it is desirable for LNG plants to minimize capital expense and operating expense by reducing the amount of equipment and controls necessary to operate the plant. Thus, it would be a significant contribution to the art and to the economy if there existed an open methane cycle that eliminated at least some of the equipment and/or controls associated with the multi-stage expansion cycle.

It is desirable to provide a novel natural gas liquefaction system that employs an open methane cycle and requires a reduced amount of equipment.

Again it is desirable to provide an open methane cycle that does not require cryogenic pumps to transport the LNG-bearing stream from the final-stage gas-liquid separation vessel to the LNG storage tank.

Once again it is desirable to provide an open methane cycle that utilizes less than three separation vessels.

It should be understood that the above desires are exemplary and need not all be accomplished by the invention claimed herein. Other objects and advantages of the invention will be apparent from the written description and drawings.

Accordingly, in one embodiment of the present invention there is provided a process for liquefying natural gas comprising the steps of: (a) flashing a pressurized liquefied natural gas stream in a first expander to provide a first flash gas and a first liquid stream; (b) flashing at least a portion of the first liquefied stream in a second expander to provide a second flash gas and a second liquid stream; (c) flashing at least a portion of the second liquid stream at or immediately upstream of a liquefied natural gas storage tank, thereby providing a third flash gas and a final liquefied natural gas product; and (d) conducting the third flash gas and the final liquefied natural gas product to the liquefied natural gas storage tank.

In another embodiment of the present invention, there is provided a process for liquefying natural gas comprising the steps of: (a) flashing a pressurized liquefied natural gas stream in a first expander to provide a first flash gas and a first liquid stream; (b) flashing at least a portion of the first liquid stream in a second expander to provide a second flash gas and a second liquid stream; (c) subcooling at least a portion of the second liquid stream in a heat exchanger, thereby providing a subcooled liquefied natural gas stream; and (d) conducting at least a portion of the subcooled liquefied natural gas stream to a liquefied natural gas storage tank.

In a further embodiment of the present invention, there is provided a process for liquefying natural gas comprising the steps of: (a) flashing a first liquefied natural gas stream in a first expander to provide a first flash gas and a first liquid stream; (b) conducting a product portion of the first liquid stream to a liquefied natural gas storage tank, with the product portion comprising both liquid and vapor; (c) conducting a refrigerant portion of the first liquid stream to a heat exchanger; (d) conducting natural gas vapors from the liquefied natural gas storage tank to the heat exchanger; and (e) combining the natural gas vapors and the refrigerant portion in the heat exchanger.

In still another embodiment of the present invention, there is provided an apparatus for liquefying natural gas. The apparatus comprises a first liquid expander, a first gas-liquid separator, a second liquid expander, a second gas-liquid separator, an indirect heat exchanger, a splitter, and a liquefied natural gas storage tank. The first gas-liquid separator is fluidly coupled to an outlet of the first expander. The second liquid expander is fluidly coupled to a liquid outlet of the first gas-liquid separator. The second gas-liquid separator is fluidly coupled to an outlet of the second expander. The indirect heat exchanger defines a first fluid flow path and a second fluid flow path that are isolated from one another. The first flow path inlet is fluidly coupled to the second liquid outlet. The splitter is fluidly coupled to an outlet of the first flow path. The liquefied natural gas storage tank has an inlet that is fluidly coupled to a product outlet of the splitter.

In yet another embodiment of the present invention, there is provided a process for liquefying a natural gas stream comprising the steps of: (a) cooling the natural gas stream in a first refrigeration cycle employing a first refrigerant; (b) cooling the natural gas stream in a second refrigeration cycle employing a second refrigerant; (c) cooling the natural gas stream in a third refrigeration cycle employing a third refrigerant; and (d) cooling the natural gas stream in a multi-stage expansion cycle comprising at least 3 expansion stages, with the multi-stage expansion cycle comprising 2 or fewer phase separators.

In yet a further embodiment of the present invention, there is provided a process for liquefying a natural gas stream comprising the steps of: (a) cooling the natural gas stream via indirect heat exchange with a first predominantly methane stream or group of streams to thereby provide a first cooled stream; (b) separating at least a portion of the first cooled stream into a first separated stream and a second separated stream; (c) compressing at least a portion of the first separated stream in a compressor; and (d) cooling at least a portion of the second separated stream via indirect heat exchange with a second predominantly methane stream or groups of streams to thereby form a second cooled stream.

In a still further embodiment of the present invention, there is provided a process for liquefying a natural gas stream comprising the steps of: (a) reducing the pressure of the natural gas stream to thereby provide a first pressure-reduced stream comprising less than about 5 mole percent vapor; (b) splitting at least a portion of the first pressure-reduced stream into a first split stream and a second split stream, each of said first and second split streams comprising less than about 5 mole percent vapor; (c) conducting at least a portion of the first split stream to a liquefied natural gas storage tank; and (d) heating at least a portion of the second split stream by indirect heat exchange with a first predominantly methane stream to thereby provide a first warmed stream.

In still yet another embodiment of the present invention, there is provided an apparatus for liquefying a natural gas stream. The apparatus comprises a methane economizer and a multi-stage methane expansion cycle. The methane economizer provides indirect heat exchange between a plurality of predominantly methane streams via a plurality of heat exchanger passes. The methane economizer comprises a first heat exchanger pass for cooling at least a portion of the natural gas stream. The methane expansion cycle receives a least a portion of the cooled natural gas stream from the first heat exchanger pass. The methane expansion cycle comprises at least 3 expanders for sequentially reducing the pressure of the natural gas stream. The methane expansion cycle comprises 2 or less phase separators.

BRIEF DESCRIPTION OF THE DRAWING FIGURES

A preferred embodiment of the present invention is described in detail below with reference to the attached drawing figures, wherein.

Figure 1:
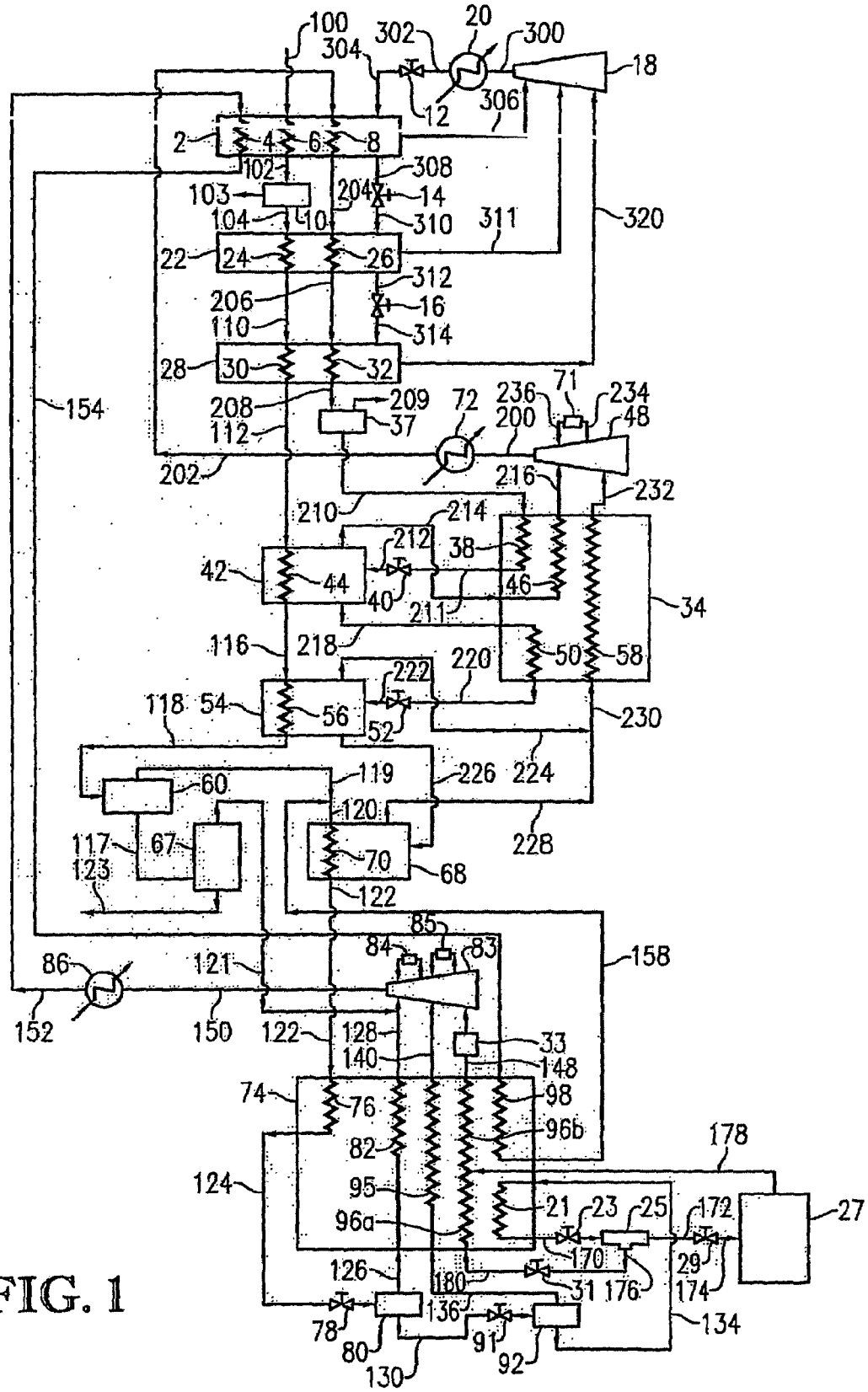
FIG. 1 is a simplified flow diagram of a cascaded refrigeration process for LNG production which employs a novel open methane refrigeration cycle utilizing only two flash drums.

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, methane or a predominately methane stream is employed as the refrigerant/cooling agent in the open cycle. This stream is comprised of the processed natural gas feed stream and the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flowrates through such equipment so as to ensure that both flowrates and approach and outlet temperatures are compatible with the required heating/cooling duty.

One of the most efficient and effective means of liquefying natural gas is via an optimized cascade-type operation in combination with expansion-type cooling. Such a liquefaction process is comprised of the sequential cooling of a natural gas stream at an elevated pressure, for example about 625 psia, by sequentially cooling the gas stream by passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60° F. to 138° F.

As previously noted, the natural gas feed stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+).

The pressurized LNG-bearing stream is then further cooled in a third cycle or step referred to as the open methane cycle via contact in a main methane economizer with refrigerant streams (e.g., flash gas streams) generated in this third cycle in a manner to be described later and via expansion of the pressurized LNG-bearing stream to near atmospheric pressure. The refrigerant streams used as a refrigerant in the third refrigeration cycle are preferably comprised in major portion of methane, more preferably the refrigerant streams comprise at least 75 mole percent methane, still more preferably at least 90 mole percent methane, and most preferably the refrigerant streams consist essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomnson expansion valves or hydraulic expanders. The expansion is followed by a separation of the pressure-reduced stream in either a gas-liquid separator or a non-phase-separating splitter (e.g., a tee). As used herein, the terms "separating" and "separation" shall refer to the operation of physically separating one feed stream into two product streams, with or without vapor-liquid phase separation. When a hydraulic expander is employed and properly operated, the greater efficiencies associated with the recovery of power, a greater reduction in stream temperature, and the production of less vapor during the flash expansion step will frequently more than off-set the more expensive capital and operating costs associated with the expander. In one embodiment, additional cooling of the pressurized LNG-bearing stream prior to expansion is made possible by first flashing a portion of this stream via one or more hydraulic expanders and then via indirect heat exchange means employing said flash gas stream to cool the remaining portion of the pressurized LNG-bearing stream prior to expansion. The warmed flash gas stream is then recycled via return to an appropriate location, based on temperature and pressure considerations, in the open methane cycle and will be recompressed.

A cascaded process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures.

The liquefaction process may use one of several types of cooling which include but is not limited to (a) indirect heat exchange, (b) vaporization, and (c) expansion or pressure reduction. In direct heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchange will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematics and apparatuses set forth in FIGS. 1, 2, 3, and 4 represent first, second, third, and fourth embodiments of the inventive open-cycle cascaded liquefaction process. Those skilled in the art will recognized that FIGS. 1 through 4 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

Figure 2:
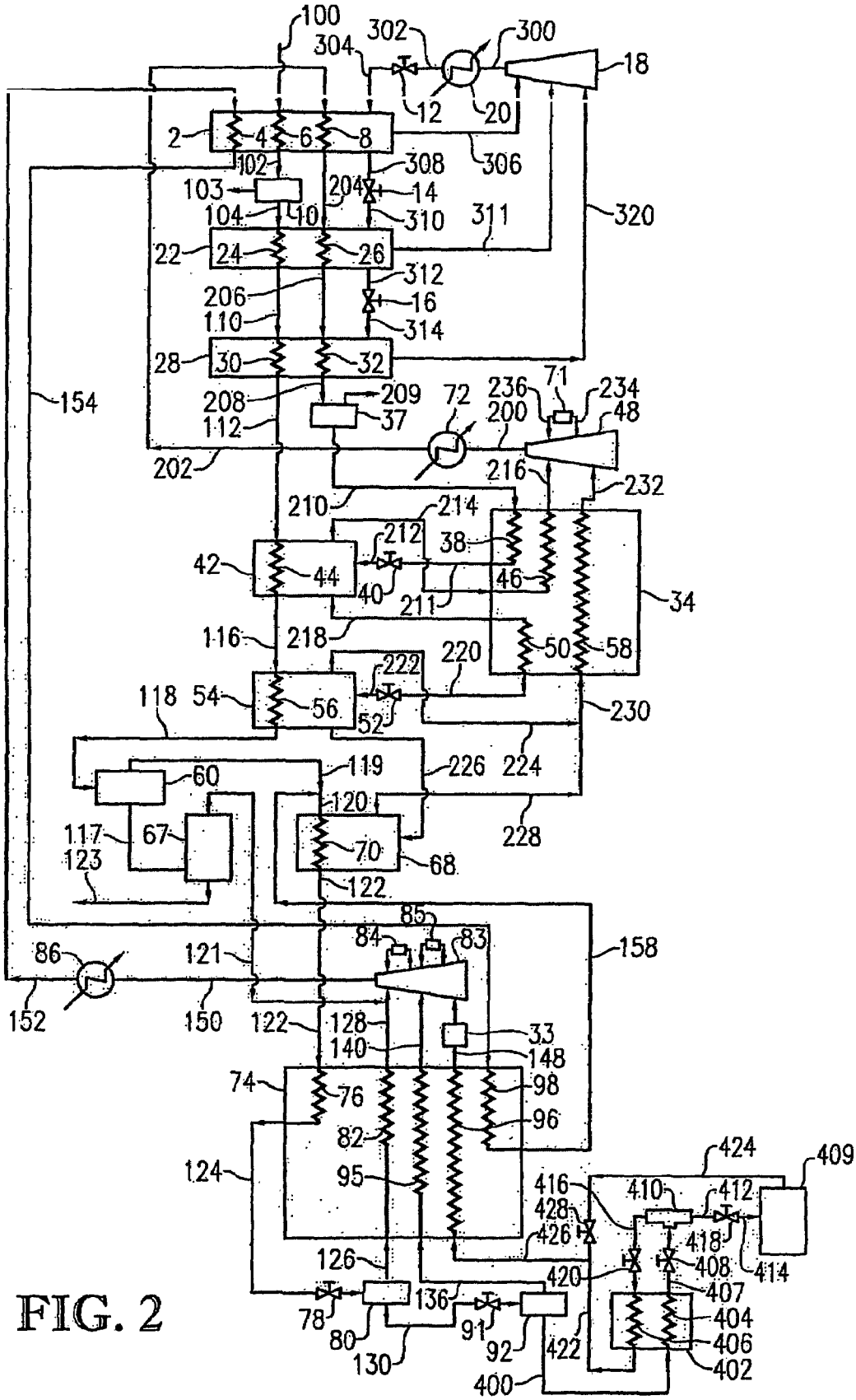
FIG. 2 is a simplified flow diagram of a cascade refrigeration process which employs an alternative embodiment of the novel open methane refrigeration cycle utilizing only two flash drum.
Figure 3:
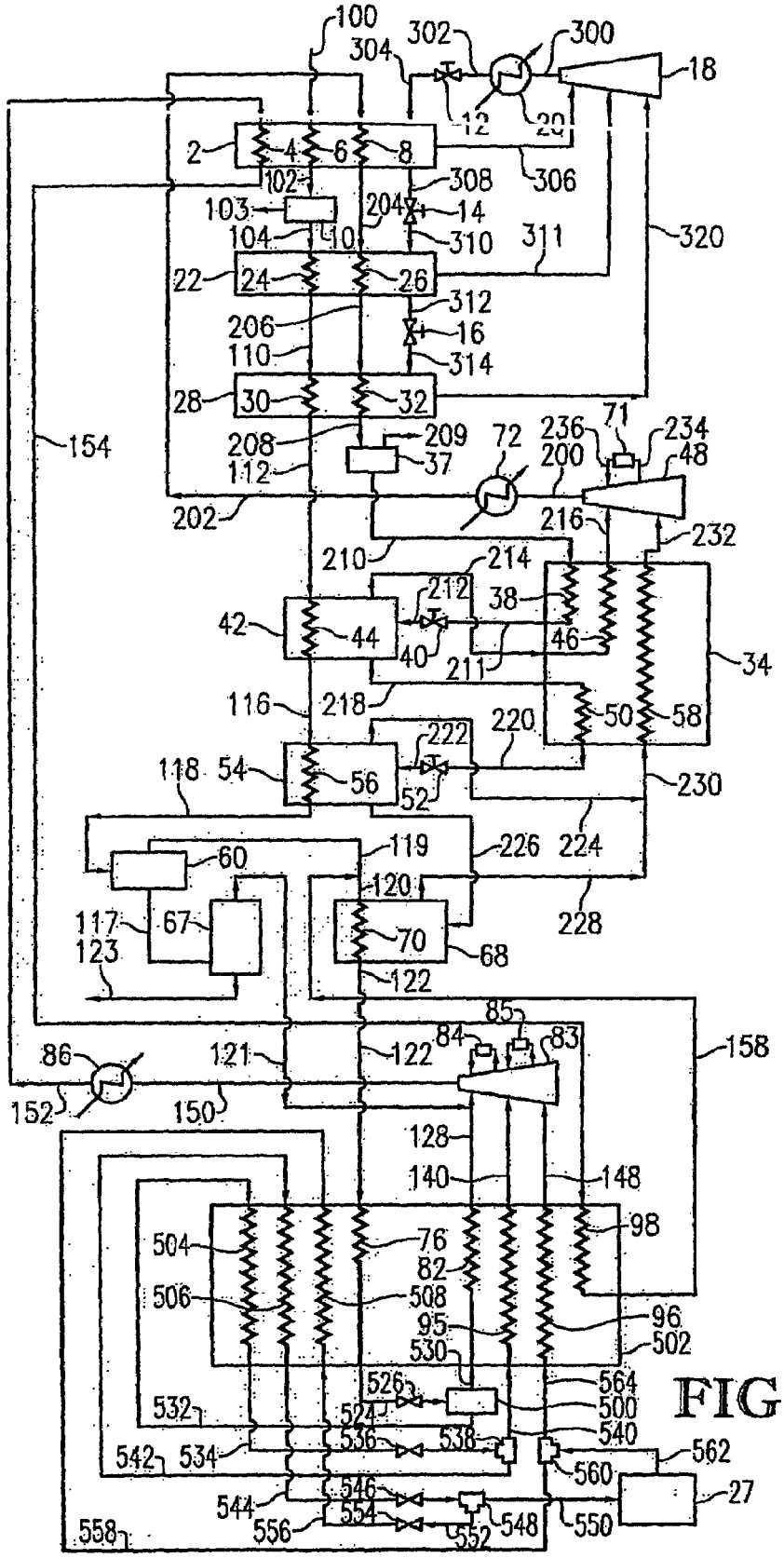
FIG. 3 is a simplified flow diagram of a cascade refrigeration process for LNG production which employs a novel open methane refrigeration cycle utilizing only one flash drum.
Figure 4:
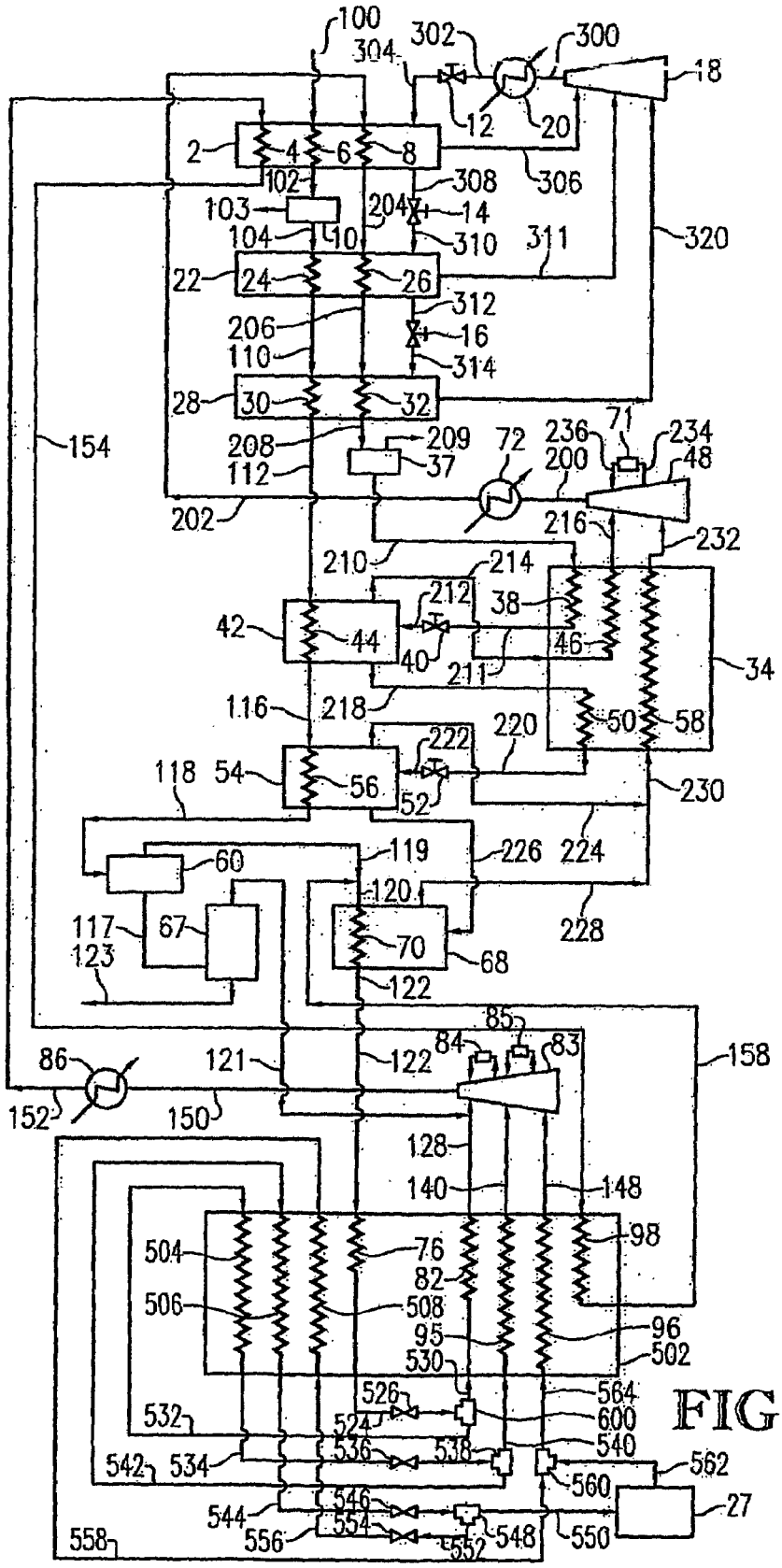
FIG. 4 is a simplified flow diagram of a cascade refrigeration process for LNG production which employs a novel open methane refrigeration cycle utilizing no flash drums.

To facilitate an understanding of FIGS. 1 through 4, the following numbering nomenclature was employed. Items numbered 1 through 99 are process vessels and equipment which are directly associated with the liquefaction process. Items numbered 100 through 199 correspond to flow lines or conduits which contain primarily methane. Items numbered 200 through 299 correspond to flow lines or conduits which contain the refrigerant ethylene. Items numbered 300 through 399 correspond to flow lines or conduits which contain the refrigerant propane. In FIG. 2, items numbered 400 through 499 are vessels, equipment, lines, or conduits of the open methane cycle whose configuration is different than the configuration shown in FIG. 1. In FIG. 3, items numbered 500 through 599 are vessels, equipment, lines, or conduits of the open methane cycle whose configuration is different than the configuration shown in FIG. 1. In FIG. 4, items numbered 600 through 699, are vessels, equipment, lines, or conduits of the open methane cycle whose configuration is different than the configuration shown in FIG. 3.

Referring to FIG. 1, pretreated natural gas is introduced to the liquefaction system through conduit 110. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 116° F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 for indirect heat exchange with gaseous methane refrigerant introduced via conduit 152, natural gas feed introduced via conduit 100, and gaseous ethylene refrigerant introduced via conduit 202 via indirect heat exchange means 4, 6 and 8, thereby producing cooled gas streams respectively transported via conduits 154, 102 and 204.

The flashed propane gas from high-stage propane chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate-stage propane chiller 22 through conduit 310 thereby providing a coolant for chiller 22.

The cooled natural gas feed stream from chiller 2 flows via conduit 102 to a knock-out vessel 10 wherein gas and liquid phases are separated. The liquid phase which is rich in $C_3$+ components is removed via conduit 103. The gaseous phase is removed via conduit 104 and conveyed to propane chiller 22. Ethylene refrigerant is introduced to chiller 22 via conduit 204. In chiller 22, the processed natural gas stream and an ethylene refrigerant stream are respectively cooled via indirect heat exchange means 24 and 26 thereby producing a cooled processed natural gas stream and an ethylene refrigerant stream via conduits 110 and 206. The thus evaporated portion of the propane refrigerant is separated and passed through conduit 311 to the intermediate-stage inlet of compressor 18. Liquid propane is passed through conduit 312, the pressure further reduced by passage through a pressure reduction means, illustrated as expansion valve 16, whereupon an additional portion of liquefied propane is flashed. The resulting two-phase stream is then fed to chiller 28 through conduit 314 thereby providing coolant to low-stage propane chiller 28.

As illustrated in FIG. 1, the cooled processed natural gas stream flows from intermediate-stage propane chiller 22 to low-stage propane chiller/condenser 28 via conduit 110. In chiller 28, the stream is cooled via indirect heat exchange means 30. In a like manner, the ethylene refrigerant stream flows from intermediate-stage propane chiller 22 to low-stage propane chiller/condenser 28 via conduit 206. In the latter, the ethylene-refrigerant is condensed via an indirect heat exchange means 32 in nearly its entirety. The vaporized propane is removed from low-stage propane chiller/condenser 28 and returned to the low-stage inlet of compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1, the processed natural gas stream exiting low-stage propane chiller 28 via conduit 112 is then introduced to a high-stage ethylene chiller 42. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant, via conduit 210, then flows to a main ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to high-stage ethylene chiller 42 via conduit 212. Vapor is removed from chiller 42 via conduit 214 and routed to the main ethylene economizer 34 wherein the vapor functions as a coolant via indirect heat exchange means 46. The ethylene vapor is then removed from ethylene economizer 34 via conduit 216 and feed to the high-stage inlet on the ethylene compressor 48. The ethylene refrigerant which is not vaporized in the high-stage ethylene chiller 42 is removed via conduit 218 and returned to the ethylene main economizer 34 for further cooling via indirect heat exchange means 50, removed from main ethylene economizer 34 via conduit 220 and flashed in a pressure reduction means illustrated as expansion valve 52 whereupon the resulting two-phase product is introduced into a low-stage ethylene chiller 54 via conduit 222. The liquefaction stream is removed from high-stage ethylene chiller 42 via conduit 116 and directly fed to low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 119 and, via conduit 117, a liquid stream rich in $C_2$+ components which is subsequently flashed or fractionated in vessel 67 thereby producing via conduit 123 a heavies stream and a second methane-rich stream which is transferred via conduit 121 and after combination with a second stream via conduit 128 is fed to the high pressure inlet port of a methane compressor 83.

The stream in conduit 119 and a cooled compressed open methane cycle gas stream provided via conduit 158 are combined and fed via conduit 120 to low-stage ethylene condenser 68 wherein this stream exchanges heat via indirect heat exchange means 70 with the liquid effluent from low-stage ethylene chiller 54 which is routed to low-stage ethylene condenser 68 via conduit 226. In condenser 68, the combined streams are condensed and produced from condenser 68 via conduit 122 is a pressurized LNG-bearing stream. The vapor from low-stage ethylene chiller 54, via conduit 224, and low-stage ethylene condenser 68, via conduit 228, are combined and routed, via conduit 230, to main ethylene economizer 34 wherein the vapors function as a coolant via indirect heat exchange means 58. The stream is then routed via conduit 232 from main ethylene economizer 34 to the low-stage side of ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is generally at a temperature of about −135° F. and about 580 psia. This stream passes via conduit 122 through a main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams. From main methane economizer 74 the pressurized LNG-bearing stream passes through conduit 124 and its pressure is reduced by a pressure reductions means which is illustrated as expansion valve 78, which evaporates or flashes a portion of the gas stream thereby generating a flash gas stream. Preferably, expansion valve 78 is operable to reduce the pressure of the LNG-bearing stream by about 40 to about 90 percent, more preferably 55 to 75 percent (e.g., if the pressure is reduced from 600 psia to 200 psia it is reduced by 66.7 percent). The flashed stream from expansion valve 78 is then passed to methane high-stage flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant via indirect heat exchange means 82. The flash gas stream (i.e., warmed flash gas stream) exits the main methane economizer via conduit 128 where it is combined with a gas stream delivered by conduit 121. These streams are then fed to the high pressure inlet of methane compressor 83. The liquid phase in conduit 130 is expanded or flashed via pressure reduction means, illustrated as expansion valve 91, to further reduce the pressure and at the same time, evaporate a second portion thereof. Preferably, expansion valve 91 is operable to reduce the pressure of the LNG-bearing stream by about 40 to about 90 percent, more preferably 60 to 80 percent. This flash gas stream is then passed to low-stage methane flash drum 92 where the stream is separated into a flash gas stream passing through conduit 135 and a liquid phase stream passing through conduit 134. The flash gas stream flows through conduit 136 to indirect heat exchange means 95 in main methane economizer 74. The warmed flash gas stream leaves main methane economizer 74 via conduit 140 which is connected to the intermediate stage inlet of methane compressor 83. The liquid phase exiting low-stage flash drum 92 via conduit 134 is passed to methane economizer 74 wherein it is subcooled via indirect heat exchange means 21 with a downstream cooling agent to be described in detail below. As used herein, the term "subcooled" shall denote a procedure for further cooling an already liquefied stream below its boiling point temperature. After subcooling in heat exchange means 21, the subcooled LNG-bearing stream exits methane economizer 74 and is passed to a pressure reduction means, illustrated as expansion valve 23, via conduit 170. After pressure reduction in expansion valve 23, the reduced pressure LNG-bearing stream is conducted to a splitter 25 wherein the stream is split into a product stream for transport to a LNG storage tank 27 via conduits 172 and 174 and a refrigerant stream for transport back to methane economizer 74 via conduits 176 and 180. A back pressure/expansion valve 29 is fluidly disposed between conduits 172 and 174 and is positioned proximate and immediately upstream of LNG storage tank. As used herein, the term "immediately upstream of" shall denote the position of an upstream component relative to a down-stream component wherein no substantial processing (e.g., gas-liquid separation, expansion, or compression) of the flow stream takes place between the upstream and downstream components. Back pressure/expansion valve 29 is operable to maintain sufficient pressure in conduit 172 so that the LNG-bearing stream in conduit 172 is maintained in a substantially liquid form. It is important to avoid two-phase flow in conduit 172 because the presence of vapor in conduit 172 can require a larger diameter conduit to scary the same quantity of LNG. Further, the presence of vapor in conduit 172 can cause a condition known as "slug flow." Such slug flow can exert undesirably high physical surge forces on the conduit which could ultimately cause damage to the conduit. Preferably, back pressure/expansion valve 29 is operable to reduce the pressure of the LNG-bearing stream by about 30 to about 80 percent, more preferably 40 to 60 percent.

Although not illustrated in FIG. 1, conduit 172 is typically longer than most other conduits in FIG. 1. In many LNG plants, the LNG storage tank is located several hundred feet from the main components of the LNG plant. This is especially true when the LNG storage tank is positioned on an ocean-going vessel that is docked in a harbor, while the main components of the LNG plant are positioned on land adjacent the harbor. Thus, conduit 172 typically has a length of more than about 20 feet, more typically more than about 50 feet, and most typically more than 100 feet. It is preferred for the distance between back pressure/expansion valve 29 and LNG storage tank to be minimized because two-phase flow will exist in conduit 174 due to flashing of the LNG-bearing stream at valve 29. Thus, it is preferred for the length of conduit 174 to be less than 50 feet, more preferably less than 20 feet, and most preferably less than 10 feet. After pressure reduction in valve 29, the LNG-bearing stream is conducted to LNG storage tank 27. In LNG storage tank 27, vapors "boil off" of the LNG, and the resulting boil off vapors are then removed from LNG storage tank 27 via conduit 178.

The refrierant portion of the subcooled LNG-bearing stream flowing out of splitter 25 through conduit 176 is preferably subjected to pressure reduction in a pressure reduction means, illustrated as expansion valve 31. The resulting cooled, pressure-reduced stream is then conducted to methane economizer 74 via conduit 180 for indirect heat exchange in heat exchange means 96. It is preferred for the first portion **96*a* of indirect heat exchange means 96 and indirect heat exchange means 21 to form two sides (i.e., a cold side and a hot side) of a common indirect heat exchanger so that the cooled pressure-reduced stream in first portion 96*a* can be used to subcool the LNG-bearing stream in heat exchange means 21. After the stream in first portion 96*a* of heat exchange means 96 is used to cool the stream in heat exchange means 21, boil off vapors from conduit 178 can be combined with the stream from first portion 96*a* and the resulting combined stream can be used in second portion 96*b* of heat exchange means 96 to cool the stream in heat transfer means 98, described in detail below. Because the temperature of the boil off vapors in conduit 178 is greater than the temperature of the stream entering first portion 96 a of heat exchange means 96 via conduit 180, it is preferred for the boil off vapor stream to be introduced into heat exchange means 96 after the stream in first portion 96*a* has been used to subcool the stream in heat exchange means 21. The combined stream from second portion 96*b* can then be conducted via conduit 148 to a suction drum 33 for removal of any liquids present in the stream. From suction drum 33, the vapor stream is conducted to the low-stage inlet of compressor 83**.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 120 and 121 prior to the third-stage of compression. The compressed gas (i.e., compressed open methane cycle gas stream) is discharged from high stage methane compressor through conduit 150, is cooled in cooler 86 and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage (i.e., high pressure) of ethylene cooling.

FIG. 2 illustrates an alternative embodiment of the present invention that provides many of the same advantages as the system shown in FIG. 1. The bulk of the components illustrated in FIG. 2 are the same as those illustrated in FIG. 1 and have the same numerical identification. The components that are different in FIG. 2 than in FIG. 1 are numbered 400-499. The main difference between FIG. 1 and FIG. 2 is the configuration of the open methane cycle, particularly the final flash stage and subcooling of the LNG-bearing stream.

FIG. 2 illustrates that the LNG-bearing stream exiting low-stage separator 92 via conduit 400 can be subcooled in a first heat transfer means 404 of a heat exchanger 402 by indirect heat exchange with a stream flowing through a second heat transfer means 406. After subcooling, the subcooled LNG-bearing stream is conducted via conduit 407 to an expansion valve 408 for pressure reduction. The resulting pressure-reduced subcooled stream is conducted to a splitter 410 where the stream is split into a product portion for transfer to a LNG storage tank 409 and a refrigerant portion for transfer to second heat transfer means 406 of heat exchanger 402. The product portion of the subcooled LNG-bearing stream is conducted to LNG storage tank 409 via conduits 412 and 414. A back pressure/expansion valve 418 is fluidly disposed between conduits 412 and 414 and immediately upstream of LNG storage tank 409. The refrigerant portion of the subcooled LNG-bearing stream is conducted to an expansion valve 420 for pressure reduction and cooling prior to being used in second heat transfer means 406 to subcool the stream in first heat transfer means 402. After use in heat exchanger 402, the stream from second heat transfer means 406 and boil off vapors from LNG storage tank 409 are routed to common conduit 426 via conduits 422 and 424 respectively. The combined stream is then conducted via conduit 426 to heat transfer means 96 for use as a refrigerant in cooling the stream in indirect heat exchange means 98.

Although the temperatures and pressures of the predominately methane stream in the open methane cycle described herein will vary depending on the composition of the natural gas and the specific operating parameters of the LNG plant, Table 1 gives preferred temperature and pressure ranges at certain locations in the open methane cycles illustrated in FIGS. 1 and 2.

TABLE 1

| CONDUIT OR | TEMPERATURE RANGE (° F.) | | PRESSURE RANGE (psia) | |
|---|---|---|---|---|
| VESSEL # FIG. 1/FIG. 2 | Preferred | Most Preferred | Preferred | Most Preferred |
| 122/122 | −110 to −160 | −125 to −145 | 550-650 | 560-590 |
| 124/124 | −125 to −175 | −140 to −160 | 550-650 | 560-590 |
| 80/80 | −155 to −205 | −170 to −200 | 190-250 | 215-235 |
| 130/130 | −155 to −205 | −170 to −200 | 180-240 | 200-220 |
| 92/92 | −190 to −240 | −205 to −225 | 50-100 | 65-85 |
| 134/300 | −190 to −240 | −205 to −225 | 40-80 | 55-65 |
| 170/305 | −210 to −260 | −235 to −255 | 40-80 | 55-65 |
| 172/312 | −220 to −270 | −235 to −255 | 25-75 | 40-55 |
| 174/314 | −225 to −275 | −240 to −260 | 10-50 | 25-35 |
| 27/309 | −225 to −275 | −240 to −260 | 10-50 | 25-35 |
| 178/324 | −210 to −260 | −235 to −245 | 10-50 | 25-35 |
| 176/316 | −220 to −270 | −235 to −255 | 25-75 | 40-55 |
| 180/326 | −240 to −290 | −255 to −275 | 2-20 | 5-10 |

The design of the open methane cycles illustrated in FIGS. 1 and 2 provides a number of advantages over prior art open methane cycles. For example, the final flashing of the LNG-bearing stream at or near the LNG storage tank allows for the elimination of at least one separation vessel used in a conventional open methane cycle. Further, such flashing of the LNG-bearing stream to near atmospheric pressure immediately upstream of the LNG storage tank maintains back pressure on the LNG-bearing stream up to the tank, thereby eliminating the need for conventional cryogenic pumps to transfer near atmospheric pressure LNG from a final separation vessel to the LNG storage tank. In accordance with conventional practice, the liquefied natural gas in the storage tank can be transported to a desired location (typically via an ocean-going LNG tanker). The LNG can then be vaporized at an onshore LNG terminal for transport in the gaseous state via conventional natural gas pipelines.

FIG. 3 illustrates an alternative embodiment of the present invention that requires the use of only one flash drum (i.e., flash drum 500) in the methane expansion cycle. Many of the components illustrated in FIG. 3 are the same as those illustrated in FIG. 1 and therefore have the same numerical identification. However, the configurations of the methane refrigeration cycle and methane expansion cycle depicted in FIG. 3 are quite different than the configurations of the methane refrigeration cycle and methane expansion cycle depicted in FIG. 1. The components in FIG. 3 that are different than in FIG. 1 are numbered 500 through 599.

The methane economizer 502 depicted in FIG. 3 includes additional indirect heat exchanger means/passes 504, 506, 508. The cooled LNG-bearing stream enters methane economizer 502 via conduit 122. In methane economizer 502, the LNG-bearing stream is cooled via indirect heat exchange means 76. The cooled LNG-bearing stream is conducted from heat exchange means 76 to a pressure reduction means, illustrated as expansion valve 526, via conduit 524. In expansion valve 526 the pressure of the LNG-bearing stream is reduced. Preferably, the LNG-bearing stream is flashed in expansion valve 526 to thereby produce a mixed vapor/liquid stream exiting expansion valve 526. The mixed vapor/liquid stream is conducted from expansion valve 526 to flash drum 500 where it is separated into a flash gas stream discharged through conduit 530 and a liquid-phase stream (i.e., pressurized LNG-bearing stream) discharged through conduit 532. The flash gas stream is transferred to methane economizer 502 via conduit 530 wherein the stream functions as a coolant via indirect heat exchange means 82. The warmed flash gas stream from indirect heat exchange means 82 exits methane economizer 502 via conduit 128 where it is combined with a gas stream delivered by conduit 121. The combined streams are then fed to the high pressure inlet of methane compressor 83. The liquid-phase stream in conduit 532 is conducted to indirect heat exchange means 504 of methane economizer 502 wherein the liquid phase is cooled via indirect heat exchange. The cooled stream from heat exchange means 504 exits methane economizer 502 via conduit 534 and is passed to a pressure reduction means, illustrated as expansion valve 536. In expansion valve 536, the pressure of the stream is reduced. It is preferred that substantially no flashing occurs across expansion valve 536. Thus, it is preferred for the pressure reduction that occurs across expansion valve 536 to cause substantially no vapor formation. As such, it is preferred for the pressure-reduced stream exiting expansion valve 536 to comprise less than about 5 mole percent vapor, or preferably less than about 2 mole percent vapor, and most preferably less than 1 mole percent vapor. The pressure-reduced LNG-bearing stream exiting expansion valve 536 is conducted to a splitter 538 wherein the stream is split, without substantial phase separation, into a first portion conducted to methane economizer 502 via conduit 540 and a second portion conducted to methane economizer 502 via conduit 542. The portion of the stream conducted through conduit 540 is heated in indirect heat exchange means 95 and then discharged from methane economizer 502 into the intermediate stage inlet of methane compressor 83 via conduit 140. The portion of the stream conducted through conduit 542 is cooled in indirect heat exchange means 506 and then discharged from methane economizer 502 via conduit 544. The cooled stream in conduit 544 is passed through a pressure reduction means, illustrated as expansion valve 546, wherein the pressure of the stream is reduced. It is preferred that substantially no flashing occurs across expansion valve 546. Thus, it is preferred for the pressure reduction that occurs across expansion valve 546 to cause substantially no vapor formation. As such, it is preferred for the pressure-reduced stream exiting expansion valve 546 to comprise less than about 5 mole percent vapor, more preferably less than about 2 mole percent vapor, and most preferably less than 1 mole percent vapor. The pressure-reduced stream exiting expansion valve 546 is then conducted to a splitter 548 wherein the stream is split, without substantial phase separation, into a first portion conducted to LNG storage tank 27 via conduit 550 and a second portion conducted to a pressure reduction means, illustrated as expansion valve 554, via conduit 552. In expansion valve 554 the pressure of the stream is reduced. It is preferred that substantially no flashing occurs across expansion valve 554. Thus, it is preferred for the pressure reduction that occurs across expansion valve 554 to cause substantially no vapor formation. As such, it is preferred for the pressure-reduced stream exiting expansion valve 554 to comprise less than about 5 mole percent vapor, more preferably less than about 2 mole percent vapor, and most preferably less than 1 mole percent vapor. The pressure-reduced stream exiting expansion valve 554 is conducted to indirect heat exchange means 508 in methane economizer 502 via conduit 556. In heat exchange means 508, the stream is warmed by indirect heat exchange. The warmed stream from heat exchange means 508 exits methane economizer 502 via conduit 558 and is conducted to a tee 560. In tee 560, the warmed stream from conduit 558 is combined with a boil-off vapor stream carried from LNG storage tank 27 to tee 560 via conduit 562. The combined streams are conducted to indirect heat exchange means 96 of methane economizer 502 via conduit 564. In indirect heat exchange means 96, the stream is heated via indirect heat exchange and then discharged from methane economizer 502 to the low-stage inlet of methane compressor 83 via conduit 148.

FIG. 4 illustrates an alternative embodiment of the invention that does not require the use of any flash drums in the methane expansion cycle. Most of the components illustrated in FIG. 4 are identical to the components illustrated in FIG. 3 and therefore have the same numerical identification. However, the methane expansion cycle illustrated in FIG. 4 employs a non-phase separating splitter 600 downstream of expansion valve 526, rather than the phase-separating flash drum 500 shown in the methane expansion cycle of FIG. 3.

Although most of the components of the system shown in FIG. 4 are similar to the components shown in FIG. 3, it is preferred for the operating parameters of the system shown in FIG. 4 to be different from the operating parameters of the system shown in FIG. 3 in order to accommodate for the replacement of flash drum 500 (FIG. 3) with splitter 600 FIG. 4). For example, in FIG. 4 it is preferred for substantially no flashing to occur across expansion valve 526 because it is preferred for substantially all of the stream entering splitter 600 to be in the liquid phase. Thus, it is preferred for the pressure-reduced stream exiting expansion valve 526 to comprise less than about 5 mole percent vapor, more preferably less than about 2 mole percent vapor, and most preferably less than 1 mole percent vapor. The cooling associated with the flashing across expansion valve 526 in FIG. 3 does not occur in the configuration shown in FIG. 4. In order to accommodate for this lack of flash-type cooling, it is preferred for the stream in conduit 524 to have a lower temperature in the methane cycle configuration of FIG. 4 than in the methane cycle configuration of FIG. 3. Table 2, below, provides a comparison of sample temperatures and pressures at various selected locations throughout the methane refrigeration/expansion cycles illustrated in FIGS. 3 and 4. For each component listed in Table 2, an inlet temperature and pressure are provided, as well as temperature and pressure changes across the component.

TABLE 2

SAMPLE TEMPERATURES AND PRESSURES IN METHANE REFRIGERATION/EXPANSION CYCLE

| | FIG. 3 | | | | FIG. 4 | | | |
|---|---|---|---|---|---|---|---|---|
| Component Number | Inlet Press. (psig) | ΔP across (psi) | Inlet Temp. (° F.) | ΔT across (° F.) | Inlet Press. (psig) | ΔP across (psi) | Inlet Temp. (° F.) | ΔT across (° F.) |
| 526 | 520 | −318 | −143 | −31 | 520 | −318 | −177 | +1 |
| 504 | 202 | −4 | −174 | −30 | 202 | −4 | −176 | −31 |
| 536 | 198 | −111 | −204 | 0 | 198 | −111 | −207 | +1 |
| 506 | 87 | −4 | −204 | −25 | 87 | −4 | −206 | −21 |
| 546 | 83 | −35 | −229 | 0 | 83 | −35 | −227 | 0 |
| 554 | 48 | −18 | −229 | 0 | 48 | −18 | −227 | −4 |
| 508 | 30 | −4 | −229 | +21 | 30 | −4 | −231 | +20 |

It should be understood that the temperatures and pressures in conduits and splitters immediately upstream of the listed components are equal to the inlet temperature and pressure of the listed component, while the temperatures and pressures in the conduits and splitters immediately downstream of the listed components are equal to the sum of the inlet temperature and pressure of the listed component and the temperature and pressure change across that component. For example, in FIG. 3 the sample temperature and pressure in splitter 548, conduit 550, and conduit 552 are −229° F. and 48 psig (i.e., the same as the inlet of expansion valve 554).

Although Table 2 provides only a single sample value for temperature, pressure, temperature, and pressure, it should be understood that values at each of these locations can vary within preferred ranges, recited below. Preferably, the temperature, pressure, temperature, and pressure values of the systems illustrated in FIGS. 3 and 4 are within about 30 percent of the actual values listed in Table 2, more preferably within about 15 percent of the actual values listed in Table 2, and most preferably within 5 percent of the actual values listed in Table 2. Thus, for example, it is preferred for the inlet pressure of component 526 in FIG. 3 to be in the range of from about 364 psig (i.e., 520 psig 30% of 520 psig) to about 676 psig (i.e., 520+30% of 520 psig), more preferably in the range of from about 442 psig (i.e., 520 psig 15% of 520 psig) to about 598 psig (i.e., 520+15% of 520 psig), and most preferably in the range of from 494 psig (i.e., 520 psig 5% of 520 psig) to 546 psig (i.e., 520+5% of 520 psig).

Table 3, below, provides preferred and most preferred ranges for the percent change in temperature and pressure across certain components of the LNG systems illustrated in FIGS. 3 and 4.

TABLE 3

PREFERRED RANGES OF TEMPERATURE AND PRESSURE CHANGES IN METHANE REFRIGERATION/EXPANSION CYCLE

| | FIG. 3 | | | | FIG. 4 | | | |
|---|---|---|---|---|---|---|---|---|
| | % ΔP across | | % Δ T across | | % ΔP across | | % Δ T across | |
| Component Number | Preferred | Most Preferred | Preferred | Most Preferred | Preferred | Most Preferred | Preferred | Most Preferred |
| 526 | >30 | 40-80 | >5 | 10-30 | >30 | 40-80 | <10 | 0-5 |
| 504 | <10 | 0-5 | >5 | 10-30 | <10 | 0-5 | >5 | 10-30 |
| 536 | >30 | 40-80 | <10 | 0-5 | >30 | 40-80 | <10 | 0-5 |
| 506 | <10 | 0-5 | >4 | 6-20 | <10 | 0-5 | >4 | 6-20 |
| 546 | >20 | 30-50 | <10 | 0-5 | >20 | 30-50 | <10 | 0-5 |
| 554 | >15 | 25-50 | <10 | 0-5 | >15 | 25-50 | <10 | 0-5 |
| 508 | <10 | 0-5 | >4 | 6-20 | <10 | 0-5 | >4 | 6-20 |

In one embodiment of the present invention, the LNG production systems illustrated in FIGS. 1-4 and described above can be simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

The invention claimed is:

1. A process for liquefying a natural gas stream, said process comprising the steps of:

(a) cooling the natural gas stream in a first refrigeration cycle employing a first refrigerant;

(b) cooling the natural gas stream in a second refrigeration cycle employing a second refrigerant;

(c) cooling the natural gas stream in a third refrigeration cycle employing a third refrigerant; and (d) cooling the natural gas stream in a multi-stage expansion cycle comprising at least 3 expansion stages, said multi-stage expansion cycle comprising 2 or fewer phase separators.

2. A process according to claim 1, said third refrigerant comprising predominantly methane.

3. A process according to claim 2, said first refrigerant comprising predominantly propane, propylene, or mixtures thereof, said second refrigerant comprising predominantly ethane, ethylene, or mixtures thereof.

4. A process according to claim 3, step (b) being perfoimed downstream of step (a), step (c) being performed downstream of step (b), step (d) being performed downstream of step (c).

5. A process according to claim 1, said process for liquefying a natural gas stream being a cascade-type refrigeration process.

6. A process according to claim 1, said third refrigeration cycle being an open methane refrigeration cycle.

7. A process according to claim 1, said third refrigeration cycle comprising a methane economizer comprising a plurality of heat exchanger passes for providing indirect heat exchange between a plurality of predominantly methane streams, step (c) including cooling the natural gas stream in a first heat exchanger pass of the methane economizer.

8. A process according to claim 7, step (d) including the substeps of:

(d1) reducing the pressure of at least a portion of the natural gas stream in a first expander to thereby provide a first pressure-reduced stream;

(d2) separating at least a portion of the first pressure-reduced stream into a first separated stream and a second separated stream;

(d3) warming at least a portion of the first separated stream in a second heat exchanger pass of the methane economizer to thereby provide a first warmed stream; and (d4) cooling at least a portion of the second separated stream in a third heat exchanger pass of the methane economizer to thereby provide a second cooled stream.

9. A process according to claim 8, substep (d1) including flashing the natural gas stream, substep (d2) including phase separating the first pressure-reduced stream, said first separated stream comprising primarily vapor, said second separated stream comprising primarily liquid.

10. A process according to claim 8, said first pressure-reduced stream, said first separated stream, and said second separated stream each comprising less than about 5 mole percent vapor.

11. A process according to claim 8; and (e) compressing at least a portion of the first warmed stream in a compressor.

12. A process according to claim 8,
step (d) including the substeps of:
(d5) reducing the pressure of at least a portion of the second cooled stream in a second expander to thereby provide a second pressure-reduced stream;
(d6) separating at least a portion of the second pressure-reduced stream into a third separated stream and a fourth separated stream;
(d7) warming at least a portion of the third separated stream in a fourth heat exchanger pass of the methane economizer to thereby provide a second warmed stream; and
(d8) cooling at least a portion of the fourth separated stream in a fifth heat exchanger pass of the methane economizer to thereby provide a third cooled stream.

13. A process according to claim 12,
said second pressure-reduced stream, said third separated stream, and said fourth separated stream comprising less than about 5 mole percent vapor.

14. A process according to claim 12; and
(e) compressing at least a portion of the second warmed stream in a compressor.

15. A process according to claim 12,
step (d) including the substeps of:
(d9) reducing the pressure of at least a portion of the third cooled stream to thereby provide a third pressure-reduced stream;
(d10) separating at least a portion of the third pressure-reduced stream into a fifth separated stream and a sixth separated stream;
(d11) conducting at least a portion of the fifth separated stream to a liquefied natural gas storage tank; and
(d12) warming at least a portion of the sixth separated stream in a sixth heat exchanger path of the methane economizer to thereby provide a third warmed stream.

16. A process according to claim 15,
said third pressure-reduced stream, said fifth separated stream, and said sixth separated stream comprising less than about 5 mole percent vapor.

17. A piocess according to claim 15,
step (d) including the substep of:
(d13) warming at least a portion of the third warmed stream in a seventh heat exchanger pass of the methane economizer to thereby provide a fourth warmed stream.

18. A process according to claim 17; and
(e) compressing at least a portion of the fourth warmed stream in a compressor.

19. A process according to claim 17; and
(e) combining a boil-off vapor stream from the liquefied natural gas storage tank with at least a portion of the third warmed stream, step (d13) including warming the combined third warmed stream and boil-off vapor stream in the seventh heat exchanger pass of the methane economizer to thereby provide the fourth warmed stream.

20. A process according to claim 1; and
(e) vaporizing liquefied natural gas produced via steps (a)-(d).

21. A process for liquefying a natural gas stream, said process comprising the steps of:
(a) cooling the natural gas stream via indirect heat exchange with a first predominantly methane stream or group of streams to thereby provide a first cooled stream;
(b) splitting the first cooled stream into a first separated stream and a second separated stream with substantially no phase separation;
(c) compressing at least a portion of the first separated stream in a compressor; and
(d) cooling at least a portion of the second separated stream via indirect heat exchange with a second predominantly methane stream or groups of streams to thereby form a second cooled stream.

22. A process according to claim 21; and
(e) prior to step (a), cooling at least a portion of the natural gas stream via indirect heat exchange with a predominantly propane or propylene stream.

23. A process according to claim 22; and
(f) prior to step (a) but subsequent to step (e), cooling at least a portion of the natural gas stream via indirect heat exchange with a predominantly ethane or ethylene stream.

24. A process according to claim 21,
said process for liquefying a natural gas stream being a cascade-type refrigeration process.

25. A process according to claim 21,
step (a) being carried out as part of an open methane refrigeration cycle.

26. A process according to claim 21,
said first and second predominantly methane streams or groups of streams comprising the same stream or group of streams.

27. A process according to claim 21, wherein
said first and second separated streams comprise less than about 5 mole percent vapor.

28. A process according to claim 21; and
(e) prior to step (c), warming at least a portion of the first separated stream via indirect heat exchange with a third predominantly methane stream or groups of streams to thereby provide a first warmed stream.

29. A process according to claim 21; and
(e) prior to step (b), reducing the pressure of at least a portion of the first cooled stream in a first expander to thereby provide a first pressure-reduced stream, step (b) including separating at least a portion of the first pressure-reduced stream into the first separated stream and the second separated stream.

30. A process according to claim 29,
step (e) including flashing the first cooled stream.

31. A process according to claim 29,
step (e) involving substantially no flashing of the first cooled stream.

32. A process according to claim 21; and
(e) reducing the pressure of at least a portion of the second cooled stream in a second expander to thereby provide a second pressure-reduced stream; and
(f) splitting at least a portion of the second pressure-reduced stream into a first split stream and a second split stream.

33. A process according to claim 32,
said second pressure-reduced stream, said first split stream, and said second split stream each comprising less than about 5 mole percent vapor.

34. A process according to claim 32; and
(g) cooling at least a portion of the second split stream via indirect heat exchange to thereby provide a third cooled stream.

35. A process according to claim 34; and
(h) warming at least a portion of the first split stream via indirect heat exchange to thereby provide a second warmed stream; and
(i) compressing at least a portion of the second warmed stream in the compressor.

36. A process according to claim 34; and (h) reducing the pressure of at least a portion of the third cooled stream in a third expander to thereby provide a third pressure-reduced stream; and (i) splitting at least a portion of the third pressure-reduced stream into a third split stream and a fourth split stream, said third pressure-reduced stream, said third split stream, and said fourth split stream each comprising less than about 5 mole percent vapor.

37. A process according to claim 36; and (j) warming at least a portion of the fourth split stream via indirect heat exchange to thereby provide a third warmed stream.

38. A process according to claim 37; and (k) conducting at least a portion of the third split stream to a liquefied natural gas storage tank.

39. A process according to claim 38; and (l) combining at least a portion of the third warmed stream with a boil-off vapor stream from the liquefied natural gas storage tank to thereby form a combined stream.

40. A process according to claim 39; and (m) warming at least a portion of the combined stream by indirect heat exchange to thereby form a fourth warmed stream; and (n) compressing at least a portion of the fourth warmed stream in the compressor.

41. A process according to claim 21; and (e) vaporizing liquefied natural gas produced via steps (a)-(d).

42. A process for liquefying a natural gas stream, said process comprising the steps of:

(a) reducing the pressure of the natural gas stream to thereby provide a first pressure-reduced stream comprising less than about 5 mole percent vapor;

(b) spliting at least a portion of the first pressure-reduced stream into a first split stream and a second split stream, each of said first and second split streams comprising less than about 5 mole percent vapor;

(c) conducting at least a portion of the first split stream to a liquefied natural gas storage tank; and (d) heating at least a portion of the second split stream by indirect heat exchange with a first predominantly methane stream to thereby provide a first warmed stream.

43. A process according to claim 42; and (e) prior to step (a), cooling at least a portion of the natural gas stream via indirect heat exchange with a second predominantly methane stream.

44. A process according to claim 43; and (f) prior to step (e), cooling at least a portion of the natural gas stream via indirect heat exchange with a predominantly propane or propylene stream.

45. A process according to claim 44; and (g) prior to step (e), cooling at least a portion of the natural gas stream via indirect heat exchange with a predominantly ethane or ethylene stream.

46. A process according to claim 42, said process for liquefying a natural gas stream being a cascade-type refrigeration process.

47. A process according to claim 42, step (a) being carried out as part of a multi-stage expansion cooling cycle.

48. A process according to claim 42, step (a) involving substantially no flashing of the natural gas stream.

49. A process according to claim 42; and (e) combining at least a portion of the first warmed stream with boil-off vapors from the liquefied natural gas storage tank to thereby form a combined stream.

50. A process according to claim 49; and (f) compressing at least a portion of the combined stream in a compressor.

51. A process according to claim 50; and (g) prior to step (i), warming at least a portion of the combined stream by indirect heat exchange.

52. A process according to claim 42; and (e) prior to step (a), reducing the pressure of at least a portion of the natural gas stream to thereby provide a second pressure-reduced stream;

(f) prior to step (a), splitting at least a portion of the second pressure-reduced stream into a third split stream and a fourth split stream; and (g) prior to step (a), cooling at least a portion of the fourth split stream by indirect heat exchange to thereby provide a first cooled stream, step (a) including reducing the pressure of at least a portion of the first cooled stream.

53. A process according to claim 52; and (h) compressing at least a portion of the third split stream in a compressor.

54. A process according to claim 53; and (i) prior to step (h), warming at least a portion of the third split stream by indirect heat exchange.

55. A process according to claim 52, step (e) involving substantially no flashing of the natural gas stream.

56. A process according to claim 52, said second pressure-reduced stream, said third split stream, and said fourth split stream comprising less than about 5 mole percent vapor.

57. A process according to claim 52; and (h) prior to step (e), cooling at least a portion of the natural gas stream via indirect heat exchange with a second predominantly methane stream.

58. A process according to claim 52; and (h) prior to step (e), reducing the pressure of at least a portion of the natural gas stream to thereby provide a third pressure-reduced stream;

(i) prior to step (k)(e), separating at least a portion of the third pressure-reduced stream into a first separated stream and a second separated stream; and (j) prior to step (e), cooling at least a portion of the second separated stream by indirect heat exchange to thereby provide a second cooled stream, step (e) including reducing the pressure of at least a portion of the second cooled stream.

59. A process according to claim 58; and (k) compressing at least a portion of the first separated stream in a compressor.

60. A process according to claim 59; and (l) prior to step (k), warming at least a portion of the first separated stream by indirect heat exchange.

61. A process according to claim 58, step (h) including flashing the natural gas stream.

62. A process according to 61, step (i) including phase separating the third pressure-reduced stream, said first separated stream comprising primarily vapor, said second separate stream comprising primarily liquid.

63. A process according to claim 58, step (h) involving substantially no flashing of the natural gas stream.

64. A process according to claim 58, said third pressure-reduced stream, said first separated stream, and said second separated stream each comprising less than about 5 mole percent vapor.

65. A process according to claim 58; and (k) prior to step (h), cooling at least a portion of the natural gas stream via indirect heat exchange with a third predominantly methane stream.

66. A process according to claim 42; and (e) vaporizing liquefied natural gas produced via steps (a)-(d).

67. An apparatus for liquefying a natural gas stream, said apparatus comprising:

a methane economizer for providing indirect heat exchange between a plurality of predominantly methane streams via a plurality of heat exchanger passes, said methane economizer comprising a first heat exchanger pass for cooling at least a portion of the natural gas stream; and a multi-stage methane expansion cycle for receiving at least a portion of the cooled natural gas stream from the first heat exchanger pass, said methane expansion cycle comprising at least 3 expanders for sequentially reducing the pressure of the natural gas stream, said methane expansion cycle comprising 2 or less phase separators.

68. An apparatus according to claim 67; and a first refrigeration cycle employing a predominantly propane or propylene refrigerant to cool the natural gas stream.

69. An apparatus according to claim 68; and a second refrigeration cycle employing a predominantly ethane or ethylene refrigerant to cool the natural gas stream, said second refrigeration cycle being disposed downstream of the first refrigeration cycle and upstream of the methane economizer.

70. An apparatus according to claim 67, said methane economizer and said methane expansion cycle being part of an open methane refrigeration cycle.

71. An apparatus according to claim 67, said methane expansion cycle comprising a first expander for reducing the pressure of the natural gas stream received from the first heat exchanger pass, said methane expansion cycle comprising a separator for separating the pressure-reduced natural gas stream received from the first expander into a first separated stream and a second separated stream, said methane economizer comprising a second heat exchanger pass for warming the first separated stream received from the separator, said methane economizer comprising a third heat exchanger pass for cooling the second separated stream received from the separator.

72. An apparatus according to claim 71, said separator being a phase separator operable to separate liquid and vapor phases of the natural gas stream.

73. An apparatus according to claim 71, said separator being a splitter for splitting the natural gas stream into multiple streams without significant phase separation.

74. An apparatus according to claim 71; and a compressor for compressing the warmed first separated stream received from the second heat exchanger pass.

75. An apparatus according to claim 71, said methane expansion cycle comprising a second expander for reducing the pressure of the cooled second separated stream received from the third heat exchanger pass, said methane expansion cycle comprising a first splitter for splitting the pressure-reduced second stream received fiom the second expander into a first split stream and a second split without substantial phase separation, said methane economizer comprising a fourth heat exchanger pass for warming the first split stream received from the first splitter, said methane economizer comprising a fifth heat exchanger pass for cooling the second split stream received from the first splitter.

76. An apparatus according to claim 75; and a multi-stage compressor for compressing the warmed first separated stream received from the second heat exchanger pass and the warmed first split stream received from the fourth heat exchanger pass.

77. An apparatus according to claim 75, said methane expansion cycle comprising a third expander for reducing the pressure of the cooled second split stream from the fifth heat exchanger pass, said methane expansion cycle comprising a second splitter for splitting the pressure-reduced second split stream received from the third expander into a third split stream and a fourth split stream, said methane economizer comprising a sixth heat exchanger pass for warming the fourth split stream received from the second splitter.

78. An apparatus according to claim 77; and a liquefied natural gas storage tank for storing the third split stream received from the second splitter.

79. An apparatus according to claim 78; and a tee for combining boil-off vapors received from the liquefied natural gas storage tank and the warmed fourth split stream received from the sixth heat exchanger pass.

80. An apparatus according to claim 79, said methane economizer comprising a seventh heat exchanger pass for warming the combined stream received from the tee.

81. An apparatus according to claim 80; and a multi-stage compressor for compressing the warmed first separated stream received from the second heat exchanger pass, the warmed first split stream received from the fourth heat exchanger pass, and the warmed combined stream received from the seventh heat exchanger pass.

* * * * *

UNITED STATES PATENT AND TRADEMARK OFFICE

CERTIFICATE OF CORRECTION

PATENT NO. : 7,404,300 B2
APPLICATION NO. : 10/523955
DATED : July 29, 2008
INVENTOR(S) : Ned P. Baudat et al.

It is certified that error appears in the above-identified patent and that said Letters Patent is hereby corrected as shown below:

On the title page [*]

Please insert -- Terminal Disclaimer filed March 18, 2008. --

Signed and Sealed this
Third Day of April, 2012

David J. Kappos

David J. Kappos
*Director of the United States Patent and Trademark Office*